US005355792A

United States Patent [19]

MacNaughton et al.

[11] Patent Number: 5,355,792

[45] Date of Patent: Oct. 18, 1994

[54] TWO-PART FRAME AND PRE-TENSIONING DEVICE THEREFOR

[75] Inventors: George MacNaughton, Andover; Steven Forti, Norwell; Dietmar Stapelfeld, Marshfield, all of Mass.

[73] Assignee: WearGuard Corporation, Norwell, Mass.

[21] Appl. No.: 886,968

[22] Filed: May 21, 1992

[51] Int. Cl.[5] ..... B05C 17/06

[52] U.S. Cl. ..... 101/127.1; 101/415.1; 38/102.2

[58] Field of Search ..... 101/415.1, 379, 382.1, 101/383, 385, 386, 126, 127, 127.1, 128, 128.1, 129; 254/201, 228, 229, 230, 231, 199, 263; 38/102, 102.1, 102.2, 102.4, 102.91; 118/33

[56] References Cited

U.S. PATENT DOCUMENTS

| | | | |
|---|---|---|---|
| 2,903,967 | 9/1959 | Levin | 101/127.1 |
| 3,126,323 | 3/1964 | Salete | 101/127.1 |
| 3,608,484 | 9/1971 | Bubley et al. | 101/127.1 |
| 3,788,216 | 1/1974 | Lambert | 101/127.1 |
| 4,080,894 | 3/1978 | Weber et al. | 101/128.1 |
| 4,194,312 | 3/1980 | Connors et al. | 38/102.91 |
| 4,255,226 | 3/1981 | Crofts et al. | 101/127.1 |
| 4,442,772 | 4/1984 | Bubley | 101/127.1 |
| 4,525,909 | 7/1985 | Newman | 38/102.1 |
| 4,694,746 | 9/1987 | Hamu | 101/128.1 |
| 4,947,561 | 8/1990 | Delacroix et al. | 38/102.91 |
| 4,991,329 | 2/1991 | Wilson | 38/102.1 |
| 4,995,178 | 2/1991 | Randolph | 38/102.1 |
| 5,003,878 | 4/1991 | Dorow et al. | 101/415.1 |
| 5,058,499 | 10/1991 | Christman | 101/127.1 |

FOREIGN PATENT DOCUMENTS

| | | | |
|---|---|---|---|
| 886311 | 8/1953 | Fed. Rep. of Germany | 101/415.1 |
| 188633 | 1/1957 | Fed. Rep. of Germany | 38/102.91 |
| 1078144 | 8/1957 | Fed. Rep. of Germany | 101/415.1 |
| 1081479 | 5/1960 | Fed. Rep. of Germany | 101/415.1 |
| 2505235 | 2/1974 | Fed. Rep. of Germany | 101/415.1 |
| 0237815 | 7/1986 | Fed. Rep. of Germany | 101/415.1 |
| 2457334 | 1/1981 | France | 101/127.1 |
| 0079953 | 5/1985 | Japan | 101/127.1 |
| 467011 | 7/1973 | U.S.S.R. | 101/127.1 |
| 711269 | 6/1954 | United Kingdom | 101/415.1 |
| 719395 | 12/1954 | United Kingdom | 101/415.1 |
| 1323920 | 7/1973 | United Kingdom | 101/127.1 |
| 2106447 | 4/1983 | United Kingdom | 101/127.1 |

*Primary Examiner*—Eugene H. Eickholt

*Attorney, Agent, or Firm*—Lieberman & Nowak

[57] ABSTRACT

A two-part frame and a pre-tensioning device useful for installing a taut sheet of material within a frame are disclosed. These devices are useful for preparing silk screens used by the printing industry. Since the subject devices can automate the preparation of silk screens, lower production costs and improved quality result.

5 Claims, 3 Drawing Sheets

TWO-PART FRAME AND PRE-TENSIONING DEVICE THEREFOR

BACKGROUND OF THE INVENTION

The subject invention relates to a two-part frame and a pre-tensioning device that are useful for installing a taut sheet of material within a frame. Although any type of sheet material may be used within the frame, it is envisioned that the frame and pre-tensioning device will be most useful for preparing silk screens used by the printing industry.

To insure proper printing, a screen must be properly tensioned so that printing ink may pass therethrough in a crisp well-defined pattern. A screen which is too loose will cause an inconsistent pattern between printings and will result in poor definition of the printed design. On the other hand, a screen which is too tight will be subject to ripping, premature wear and a distortion of hole size, which causes uneven application of the ink upon the printed surface. Although many attempts at creating a properly tensioned screen have been employed in the past, no time efficient method has proved entirely satisfactory. Accordingly, one object of the subject invention is to create a properly tensioned frame in a fraction of the time required by prior art methods.

Herbert S. Levin, U.S. Pat. No. 2,903,967, issued Sep. 15, 1959, teaches a frame which stretches a wire mesh without causing punctures. In this invention, a rectangular frame is used. A vertical flange extends along the inner periphery of the rectangular frame and a screen is suspended between the edges of this vertical flange. The edges of the screen extending over the flange are clamped to a floating bar which extends substantially the length of each side of the frame exterior to the flange. The floating bar is connected to a screw and nut combination which allows the bar to be moved upward or downward perpendicular to the plane of the frame. By tightening a nut, the floating bar is raised upward thereby tightening the screen. By variably tightening a plurality of nuts, the screen may be tightened in a uniform fashion. Unfortunately, tension cannot be quantitatively determined and the tightening of the nuts, as well as the clamping of the screen, is done manually. Accordingly, the Levin frame is not suitable to large scale commercial operations.

Kaino Johannes Hamu, U.S. Pat. No. 3,962,805, issued Jun. 15, 1976, teaches a gripping device for a thin flexible piece of sheet material. A rectangular frame is used having a vertical flange which defines the interior perimeter of a rectangular frame. Channel members having a longitudinal channel of tampered cross-section are located exterior to the flange. The sheet material to be gripped is inserted through the channel and an anchor bar is placed therein to hold the sheet material within the channel. Gripper bars hold the channel members and are threadably mounted upon bolts that are secured through the frame. By turning the bolts, the gripper bars are pulled laterally away from or moved towards the center of the frame to adjust tension on the screen.

Todders, et al., U.S. Pat. No. 4,194,312, issued Mar. 25, 1980, teach a needlepoint supporting frame and clip assembly. Like other sheet material tensioning devices, the needlepoint supporting frame and clip assembly are rectangular in configuration. The sheet material in the Todders, et al. patent, is held in place by a plurality of clips. Tension in the frame is regulated by the movement of the four frame sides either toward or away from each other.

The subject invention provides a simple two-part frame which is useful for securing a piece of sheet material that is preferably presented in the pre-tensioned condition. To place a sheet material in this pre-tension condition, the subject invention provides a pre-tensioning device. The pre-tensioning device consists of a plurality of engaging means for gripping opposite ends of the sheet material to be secured within the frame. The engaging means are then retracted to place the sheet material in a taut condition. Typically, the tension upon the sheet material can be regulated by the amount of pressure used to retract the engaging means.

Through the use of an automated pre-tensioning device and two-part frame, a process which typically takes greater than two minutes, can be reduced to tens of seconds. This represents a major advance in the field of silkscreen technology which will ultimately result in a lower costs and improved quality.

SUMMARY OF THE INVENTION

The subject invention provides a two-part frame for holding sheet material having an upper frame and a lower frame. The lower frame has a channel therein which is configured so that the upper frame can be inserted within the channel. This combination holds the sheet material between the upper frame and the lower frame.

The subject invention also provides a pre-tensioning device for holding sheet material. This device comprises means for engaging the sheet material, means for drawing the material taut, and means for regulating the amount of tension in the material. In the preferred version of the subject invention, the frame and pre-tensioning device are used in tandem.

BRIEF DESCRIPTION OF THE FIGURES

FIG. 1B—A perspective view of the retainer clip.

FIG. 6B—A side view of a pair of opposed rigid jaws for use with the pre-tensioning device.

DETAILED DESCRIPTION OF THE INVENTION

The subject invention will now be described in terms of its preferred embodiments. These embodiments are set forth to aid in the description of the subject invention, but are not to be construed as limiting.

Figure 1A:
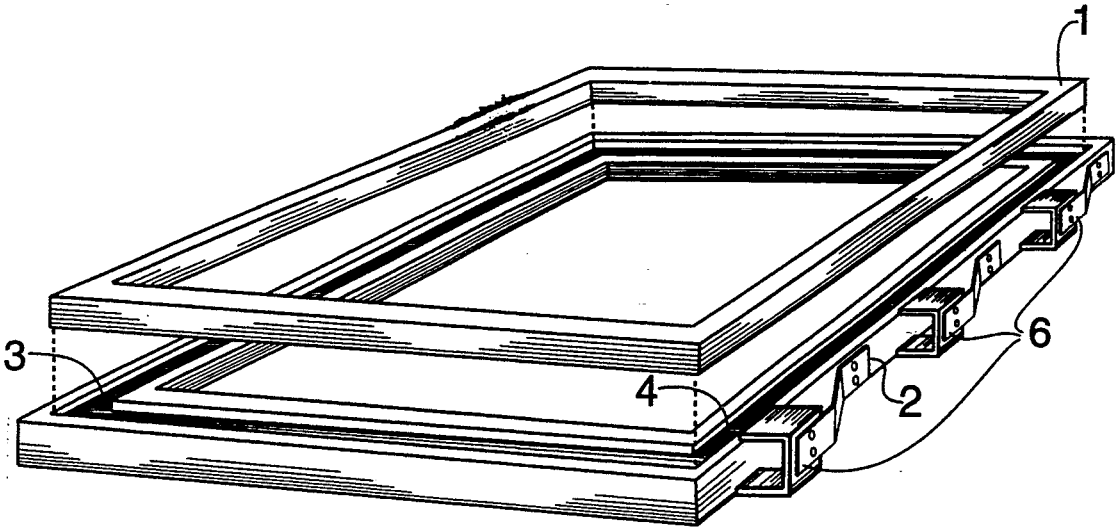
FIG. 1A—A perspective view of the two-part frame of the subject invention.

FIG. 1A depicts a two-part frame usable in the subject invention. The two-part frame consists of an upper frame (1) and a lower frame (2). The size and shape of the frame may vary depending upon the use for which the sheet material is to be put. Although any shape (e.g., circular, round, rectangular, oval, hexagonal, triangular, etc.) may be utilized, for the printing industry, the frame will typically be rectangular with dimensions of approximately 17 inches by 21 inches.

As depicted in FIG. 1A, the upper frame (1) is configured so as to fit in a channel (3) in lower frame (2). Within this channel is a layer of a resilient material (4), such as foam. This foam may be of any type known to those skilled in the art, but typically comprises a urethane, rubber, silicone, or cellulose-type foam material. The purpose of the resilient material (4) is to provide an upward force against the upper frame (1) when the upper frame (1) is inserted into channel (3) of lower frame (2).

Figure 2:
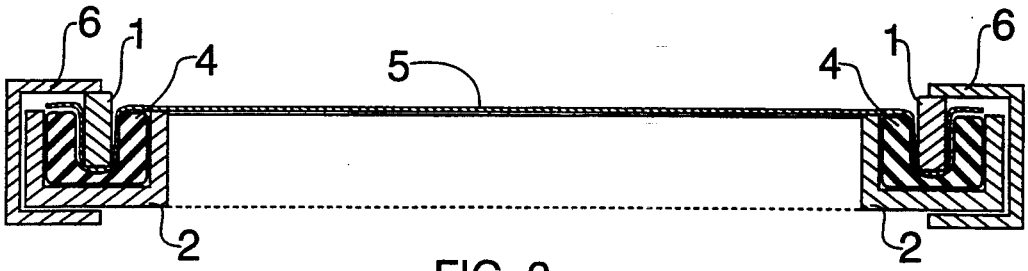
FIG. 2—A cross sectional view of the two-part frame of the subject invention in the operative position.

To operate the two-piece frame and produce a taut piece of material (5), sheet material (5) is laid across the upper surface of lower frame (2) so as to completely cover the entire opening of channel (3). Upper frame (1) is then placed above channel (3). Upper frame (1) is then pushed downward into channel (3) thereby compressing resilient material (4) (see FIG. 2). As upper frame (1) contacts resilient material (4), it grips sheet material (5). As upper frame (1) is compressed into the resilient material (4), the sheet material (5) is stretched in direct proportion to the compression and displacement of the resilient material. A substantial force is currently used to compress upper frame (1) into resilient material (4) (approximately 8–9 tons). This force is applied via a press (currently by four pneumatic cylinders) which may be of any suitable type known to those skilled in the art. The effect of this compression is to render sheet material (5) taut within the confines of the two-piece frame.

Figure 1B:
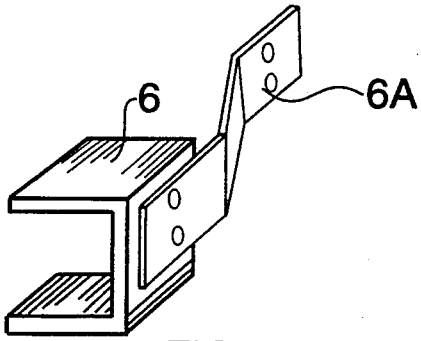

To retain upper frame (1) within channel (3) of lower frame (2), a plurality of retainer clips (6) are utilized (preferably 8 to 10). The retainer clips (6) (see FIG. 1B) may be of any suitably rigid material, such as metal, and are preferably made of stainless steel. In the preferred embodiment of the subject invention, retainer clips (6) are springedly mounted upon lower frame (2). Typically, this mounting is effected by a sheet of flexible material (6A), such as a flat spring, attached at one end to lower frame (2) and at the other end to clip (6). In the current preferred embodiment, frames (1 and 2) are made of aluminum, flat springs (6A) are composed of beryllium copper, and clips (6) are stainless steel.

Figure 3:
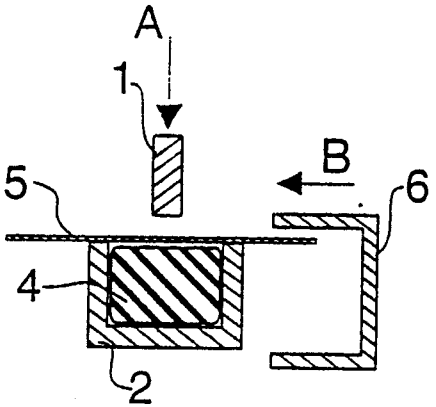
FIG. 3—A cross sectional view of the two-part frame in the loading position.

FIG. 3 shows the retainer clip in the non-engaged position. After the sheet material (5) is in place (as depicted in FIG. 3) upper frame (1) is moved in a downward direction relative to lower frame (2). This causes upper frame (1) to contact sheet material (5) and pull sheet material (5) so as to render it taut across lower frame (2). After upper frame (1) is fully compressed against resilient material (4), retaining clip (6) is moved in the direction of Arrow B so as to maintain upper frame (1) in contact with resilient material (4), and therefore in contact with lower frame (2). This is typically accomplished by actuating the retainer clips (6) using pneumatic cylinders (not depicted). Retaining clip (6) is then held in place by friction produced by upper frame (1) which is being forced upward by the compacted resiliency of resilient material (4).

Figure 5:
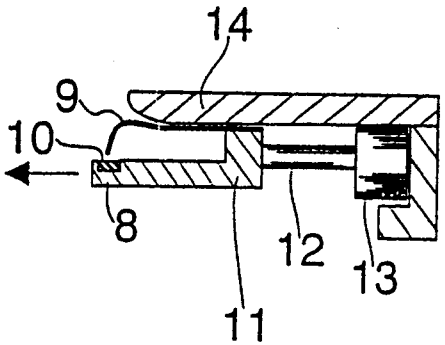
FIG. 5—A cross sectional view of one side of the pre-tensioning device in the loading position.
Figure 4:
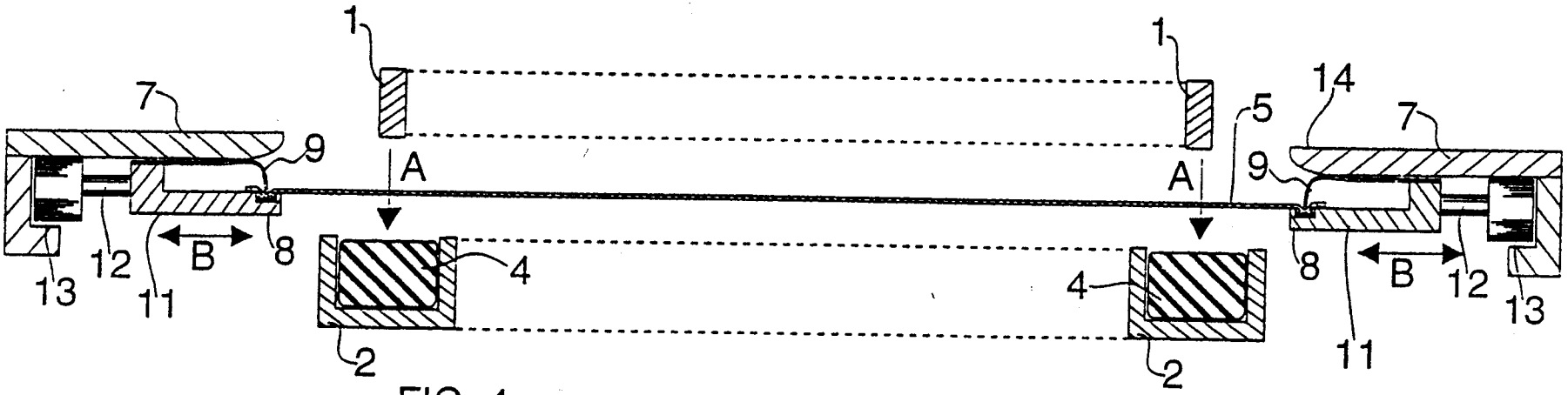
FIG. 4—A cross sectional view of the two-part frame and pre-tensioning device. The two-part frame is in the loading position and the pre-tensioning device is depicted bearing a sheet of material under tension.
Figure 6A:
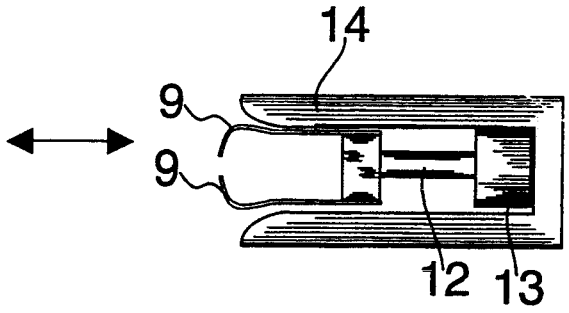
FIG. 6A—A side view of a pair of opposed flexible jaws for use with the pre-tensioning device.
Figure 6B:
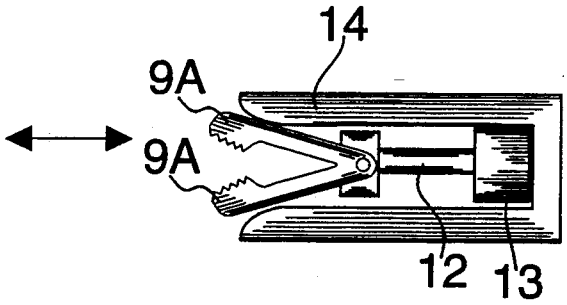

FIG. 4 shows a preferred embodiment of the subject invention showing a pair of pre-stretchers (7) located exterior to the periphery of the combined upper frame (1) and lower frame (2). Under typical conditions, 4 to 6 or more prestretchers (7) may be used. The pre-tensioning device operates by gripping the sheet material (5) between a stationary jaw (8) and a flexible jaw (9). The stationary jaw (8) typically has an area of softer material (10) located thereon at a position opposite that of the flexible jaw (9) when the stationary jaw (8) and the flexible jaw (9) are juxtaposed. This material is preferably made from silicone rubber or urethane foam. Flexible jaw (9) may be made of any suitable material known to those in the art, however, it is preferably made from spring steel, beryllium copper or resilient plastic. Flexible jaw (9) is moved toward the stationery jaw (8) by the retraction of the engaging head (11). As depicted in FIG. 4, engaging head (11) moves in the direction of Arrow B. In the loading position (see FIG. 5), sheet material (5) can be placed between flexible jaw (9) and stationery jaw (8). The engaging head (11) is then moved in a direction away from the frame by the retraction of piston rod (12) into cylinder (13). The drawing back of the piston rod (12) into the cylinder (13) causes flexible jaw (9) to contact pawl (14) which causes flexible jaw (9) to deflect against stationary jaw (8) thereby gripping a piece of sheet material (5) located therebetween. Typically, piston rod (12) is moved within cylinder (13) by a pneumatic system utilizing a pressurized fluid, such as air. Various jaw structures and configurations may be utilized. For example, both jaws could be formed so that they move relative to each other. Likewise, both jaws may be flexible (9), or conversely, rigid (9A) (see FIGS. 6A and 6B).

Figure 7:
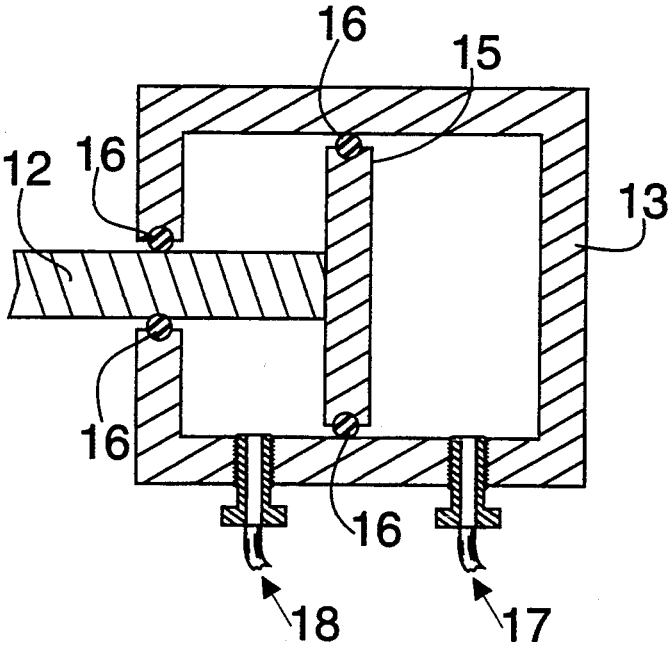
FIG. 7—A cross sectional view of a pneumatic system for use with the subject invention.

The pneumatic system (see FIG. 7) operates by asserting pressure upon piston (15) located within cylinder (13). By employing such a system, the details of which are readily determinable by one skilled in the art, an infinitely variable pressure can be asserted by the pre-tensioning device. Briefly, the piston (15) is slidably mounted within cylinder (13) and piston rod (12) is fixedly attached to piston (15). The cylinder is kept relatively airtight by the presence of O-rings (16) located around piston (15) and piston rod (12). Piston (15) is caused to move by the introduction of pressurized air into cylinder (13). Air introduced under pressure into the rear pore (17) causes the piston rod (12) to move in the outward direction, whereas air introduced under pressure into the front pore (18), causes piston rod (12) to move in the inward direction. This permits the two-part frame to engage and mount sheet material (5) at a variably controlled tensions.

Although the subject invention has been described in terms of its preferred embodiment, other methods of asserting pressure to maintain the sheet material (5) in the taut condition may also be employed. An example of such a system would be a simple motor using a variable tension drag device.

Upon reading the subject application, various alternative embodiments will become obvious to those skilled in the art. These alternative embodiments are to be considered within the scope and spirit of the subject invention. Accordingly, the subject mentioned is only to be limited by the claims which follow and their equivalents.

What is claimed is:

1. A system for holding sheet material, which comprises:

(a) a pre-tensioning device including a pair of opposed jaws for engaging the sheet material, means for drawing the material taut, and means for regulating the amount of tension in the material; and (b) a two-part frame for receiving the sheet material from the pre-tensioning device, the two-part frame including an upper frame and a lower frame, the lower frame having a channel therein which is configured so that the upper frame can be inserted within the channel to hold the sheet material between the upper frame and lower frame.

2. A system of claim 1, wherein the channel of the lower frame has a resilient material located therein.

3. A system of claim 1, wherein the two-part frame further comprises a plurality of retaining clips for retaining the upper frame within the channel of the lower frame.

4. A system for holding sheet material, which comprises:

(a) a pre-tensioning device including an engaging member that can be retracted to draw the material taut, means for retracting the engaging member and means for regulating the amount of tension in the material; and (b) a two-part frame for receiving the sheet material from the pre-tensioning device, the two-part frame including an upper frame and a lower frame, the lower frame having a resilient material-bearing channel therein which is configured so that the upper frame can be inserted into the channel to hold the sheet material between the upper frame and the lower frame, the resilient material providing an upward force against the upper frame when the upper 5. A system of claim 4, wherein the two-part frame further comprises a plurality of retaining clips for retaining the upper frame within the channel of the lower frame.

* * * * *

UNITED STATES PATENT AND TRADEMARK OFFICE

CERTIFICATE OF CORRECTION

PATENT NO. : 5,355,792

DATED : October 18, 1994

INVENTOR(S) : MacNaughton et al.

It is certified that error appears in the above-indentified patent and that said Letters Patent is hereby corrected as shown below:

Column 2, line 45, change "FIG. 3 - A cross sectional view" to "FIG. 3 - A partial cross sectional view"

Column 6, line 12, after "the upper", insert "frame is inserted into the channel."

Signed and Sealed this

Fourteenth Day of November, 1995

*Attest:*

Bruce Lehman

BRUCE LEHMAN

*Attesting Officer*

*Commissioner of Patents and Trademarks*